US005255745A

United States Patent [19]

Czyrek

[11] Patent Number: 5,255,745

[45] Date of Patent: Oct. 26, 1993

[54] REMOTELY OPERABLE HORIZONTAL CONNECTION APPARATUS AND METHOD

[75] Inventor: Roman W. Czyrek, W. Yorkshire, England

[73] Assignee: Cooper Industries, Inc., Houston, Tex.

[21] Appl. No.: 900,888

[22] Filed: Jun. 18, 1992

[51] Int. Cl.[5] ..... E21B 43/013

[52] U.S. Cl. ..... 166/347; 166/341

[58] Field of Search ..... 166/347, 338, 341, 344, 166/368; 405/169, 158

[56] References Cited

U.S. PATENT DOCUMENTS

| | | | |
|---|---|---|---|
| Re. 27,340 | 4/1972 | Williams et al. | 166/347 |
| 3,592,014 | 7/1971 | Brown et al. | 405/169 |
| 4,284,142 | 8/1981 | Kirkland | 166/381 X |
| 4,436,157 | 3/1984 | Brooks | 166/344 |
| 4,591,292 | 5/1986 | Stevens et al. | 166/347 X |
| 4,676,696 | 6/1987 | Laursen | 405/169 |
| 4,784,525 | 11/1988 | Francois | 405/191 |
| 4,842,075 | 6/1989 | Kalvenes et al. | 166/347 X |

*Primary Examiner*—Stephen J. Novosad

*Attorney, Agent, or Firm*—Jackie L. Duke; Alan R. Thiele; Eddie E. Scott

[57] ABSTRACT

A remotely operable horizontal connection apparatus apparatus and method for establishing an annulus access connection with a wellhead housing using the weight of the valve connection apparatus to aid in positioning and securing the valve connection apparatus to an annulus access port disposed on the wellhead housing. The apparatus comprises a wellhead housing with a substantially horizontal annulus access port, a valve with a remotely operable collet connector for sealingly engaging the access port, a guide base for maintaining the wellhead housing in a substantially vertical position with an inclined ramp extending laterally from the guide base, and a cradle for installing the valve utilizing the slope of the ramp and the horizontal component of the weight of the cradle and valve and connector assembly to urge the connector into engagement with the annulus access port.

19 Claims, 7 Drawing Sheets

REMOTELY OPERABLE HORIZONTAL CONNECTION APPARATUS AND METHOD

BACKGROUND

This invention relates to a novel apparatus and method for establishing an annulus access connection with a wellhead housing using the weight of the valve connection apparatus to aid in positioning and securing the valve connection apparatus and thereby eliminate the need for remotely operable robotic manipulators in performing such operations.

Horizontal annulus connections are typically made using an active method, i.e., requiring a combination of remotely operable robotics and remotely operated vehicle. In using this method four distinct operational stages are required to make a horizontal connection. The first stage requires a valve and connector assembly to be landed in close proximity of the remotely operable robotics. The second stage requires engaging the remotely operable robotics with the valve and connector assembly. The third stage requires operating the remotely operable robotics to preload the mating hubs of the connector and the annulus access port. The fourth stage calls for the connector to be closed to establish a fluid tight connection between the valve and connector assembly and the annulus access port. This four stage sequence requires the remotely operable robotics to perform a series of complex operations to provide for the initial alignment and preloading of the annulus connection.

The use of these remotely operable robotics requires great skill and dexterity by the operator to be properly performed. The robotics themselves are complex hydraulically operated mechanical apparatus which are expensive to operate and require considerable maintenance. The present invention overcomes these problems by providing a novel method and apparatus for installing a valve and connector assembly without requiring the use of such complex and expensive extraneous machines.

U.S. Pat. No. 3,592,014 to W. Brown et al. discloses a system for remotely making flowline connections in a subsea environment which utilizes a stinger connector and float positioned on one of the flowline ends. The stinger connector and float are pulled down to a subsea station where the stinger connection is made.

U.S. Pat. No. 4,676,696 to N. K. Laursen is an example of another apparatus used to install a flowline section in a horizontal position at the seabed. A vertically disposed guide tube with guide funnel is positioned on a subsea manifold and receives a mandrel on the end of the flowline which is lowered vertically. The mandrel is shaped to cooperate with the guide tube and can be pivoted into a horizontal position after the connection is made.

U.S. Pat. No. 4,784,525 to D. Francois discloses an apparatus for installing equipment subsea in a horizontal position. A servicing module is lowered to a submerged unit and connected thereto by a hydraulically actuated bolt screwing mechanism.

U.S. Pat. No. Re. 27,340 to L. E. Williams et al. discloses an apparatus for connecting a subsea tree to a horizontally disposed flowline axially spaced therefrom. A connector body is lowered from the surface into position between the adjacent ends and operated to establish a fluid tight connection between the two members.

SUMMARY

A remotely operable horizontal connection apparatus and method for establishing an annulus access connection with a wellhead housing using the weight of the valve connection apparatus to aid in positioning and securing the valve connection apparatus to an annulus access port disposed on the wellhead housing. The apparatus comprises a wellhead housing with a substantially horizontal annulus access port, a valve with a remotely operable collet connector for sealingly engaging the access port, a guide base for maintaining the wellhead housing in a substantially vertical position with an inclined ramp extending laterally from the guide base, and a cradle for installing the valve utilizing the slope of the ramp and the horizontal component of the weight of the cradle and valve and connector assembly to urge the connector into engagement with the annulus access port.

An object of the present invention is to provide a weight set connection apparatus for use with a wellhead housing providing horizontal connection with an annulus access port formed on the wellhead housing.

Another object of the present invention is to provide a weight set connection apparatus for making a horizontal connection which eliminates the need for remotely operable robotic manipulators in performing such operations.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
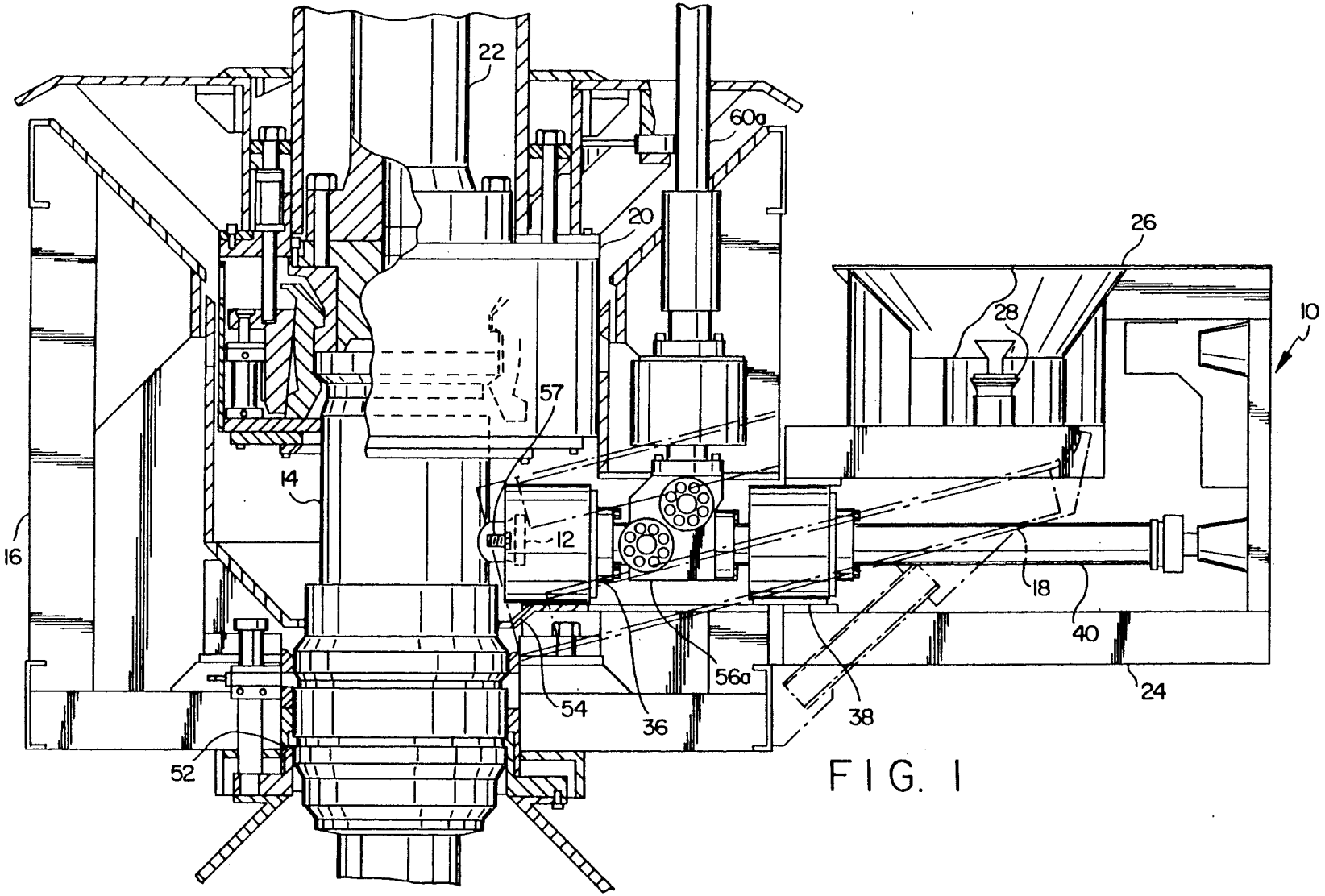
FIG. 1 is an elevation view, partly in section, of the preferred embodiment of the remotely operable horizontal connection apparatus with the valve connection apparatus secured to the annulus access port.
Figure 2:
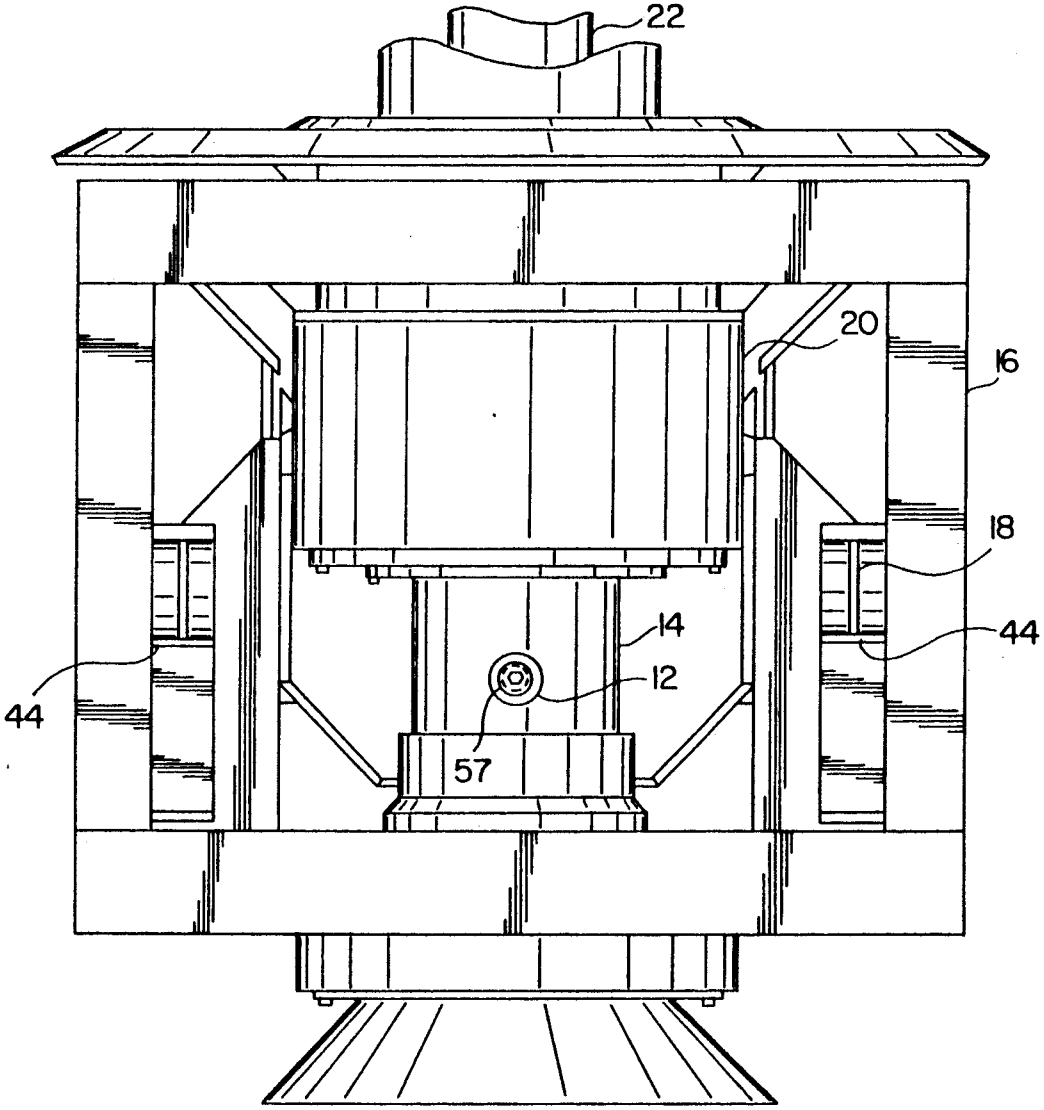
FIG. 2 is an elevation view of the guidebase, wellhead housing and inclined ramp with the valve connection apparatus removed.

With reference to FIG. 1 the remotely operable horizontal connection apparatus, denoted generally by numeral 10, is shown connected to a horizontal annulus access port as hub 12 disposed on wellhead housing 14.

Wellhead housing 14 is vertically positioned within guidebase 16 with inclined ramp 18 (shown in phantom) laterally disposed thereon. Wellhead housing 14 is surmounted by a collet connector 20 which in turn connects to riser assembly 22. Riser assembly connects with with a drilling rig and surface pressure control equipment in a manner well known to those skilled in the art.

Figure 6:
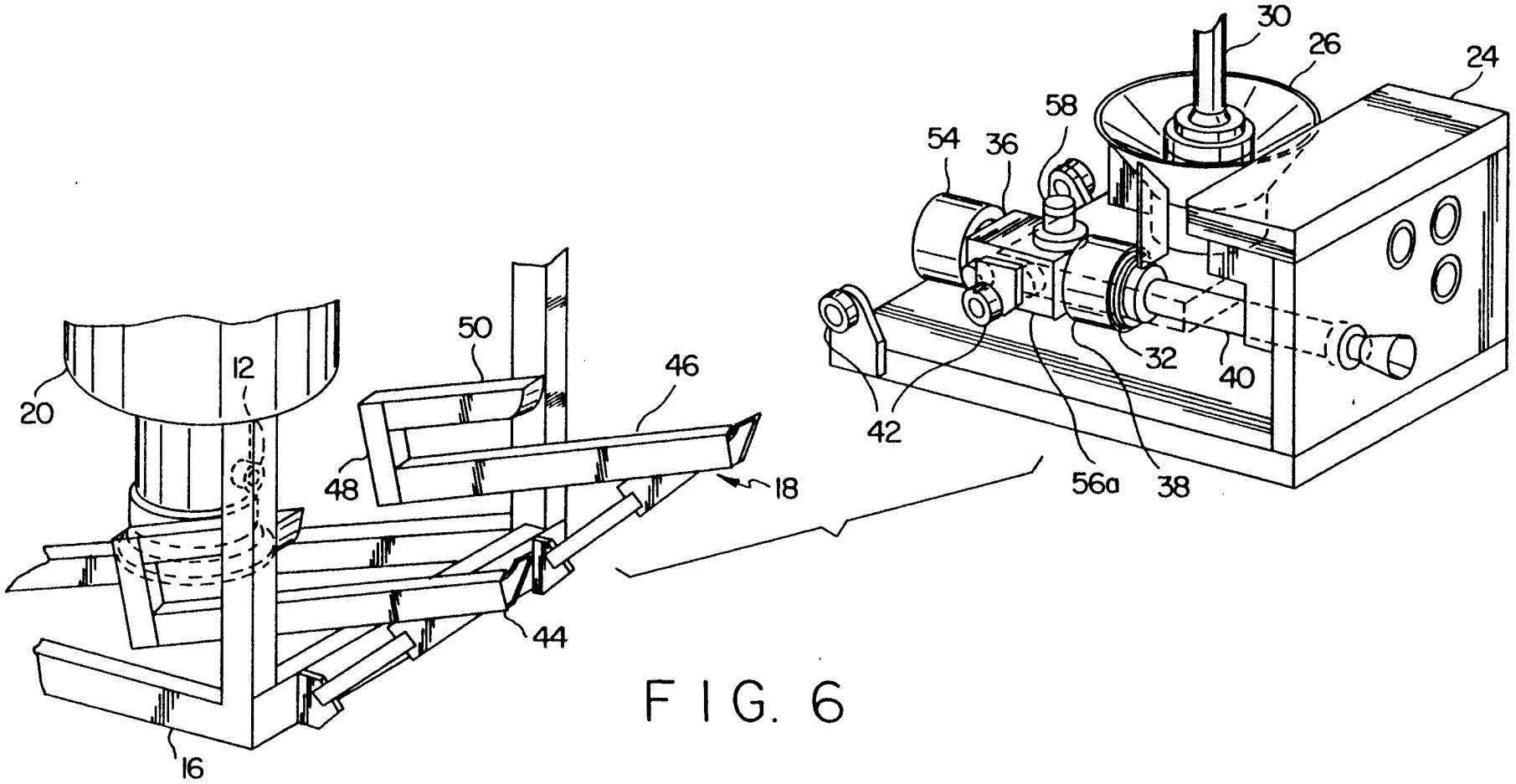
FIG. 6 is a perspective view showing the valve connection assembly being lowered to the inclined ramp on the guidebase.

As best seen in FIG. 6, the horizontal connection apparatus 10 is comprised of a support frame or installation cradle 24 with an upwardly facing guide funnel 26 disposed on its upper face. A clamp hub 28 is centrally located within guide funnel 26 and is connected to installation tool 30 during installation and retrieval operations. Pressurized hydraulic fluid for operating the installation tool 30 and the horizontal connection apparatus 10 is supplied through hoses (not shown) strapped to the installation tool in a manner well known to those skilled in the art.

Figure 5:
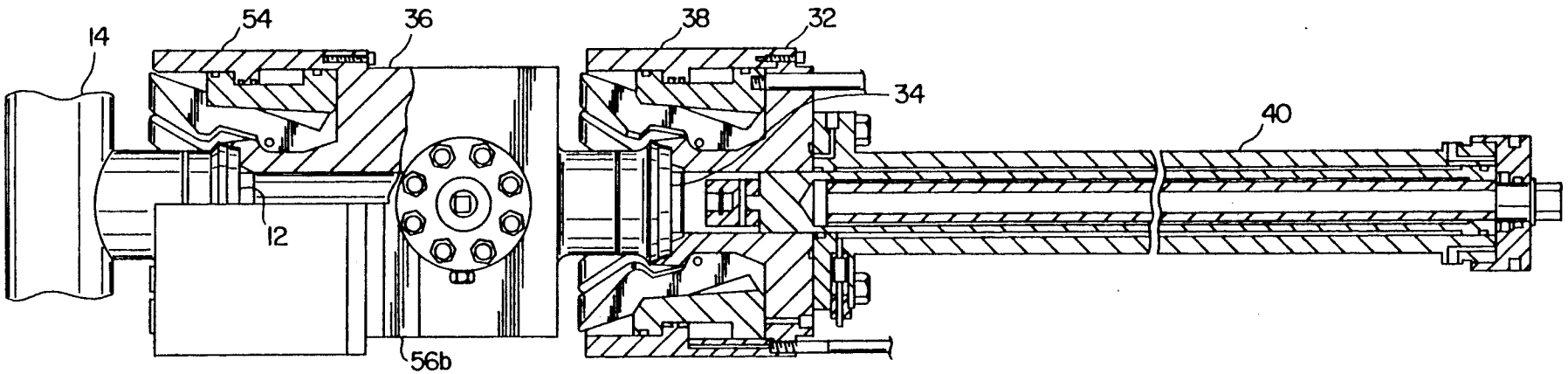
FIG. 5 is an elevation view, partly in section, of the valve connection apparatus, wellhead hub and lubricator connector used for installing and removing annulus valves.

Positioned on support frame 24 is combination latching connector and lubricator tool 32 seen in section in FIG. 5. Lubricator tool 32 connects to hub 34 of annulus valve connector assembly 36 which in turn connects to hub 12 of wellhead housing 14. Lubricator tool 32 includes collet connector 38 with hydraulically actuated lubricator tool 40 bolted thereto. Lubricator tool 32 is attached to support frame 24 and allows horizontal connection apparatus 10 to be disconnected from annulus valve connector assembly 36 and retrieved to the surface. Additionally hydraulically actuated lubricator tool 40 can be operated by a remotely operated vehicle (ROV) for installing a valve removal plug within annulus access port hub 12. A suitable means for engaging inclined ramp 18 as rollers 42 are positioned in pairs on opposite sides of support frame 24.

Referring to FIG. 6, incline ramp 18 includes track 44 defined by spaced apart ramp legs 46 which are parallel and slope inwardly and downwardly to stop legs 48. Extending laterally outwardly from stop legs 48 are upper legs 50 which are parallel to ramp legs 46 and spaced therefrom to further define track 44 and closely receive rollers 42. Rollers 42 are positioned on support frame 24 so that when horizontal connection apparatus 10 is landed on inclined ramp 18, lubricator tool 32 and annulus valve connector assembly 36 are horizontal as seen in FIG. 1.

Figure 3:
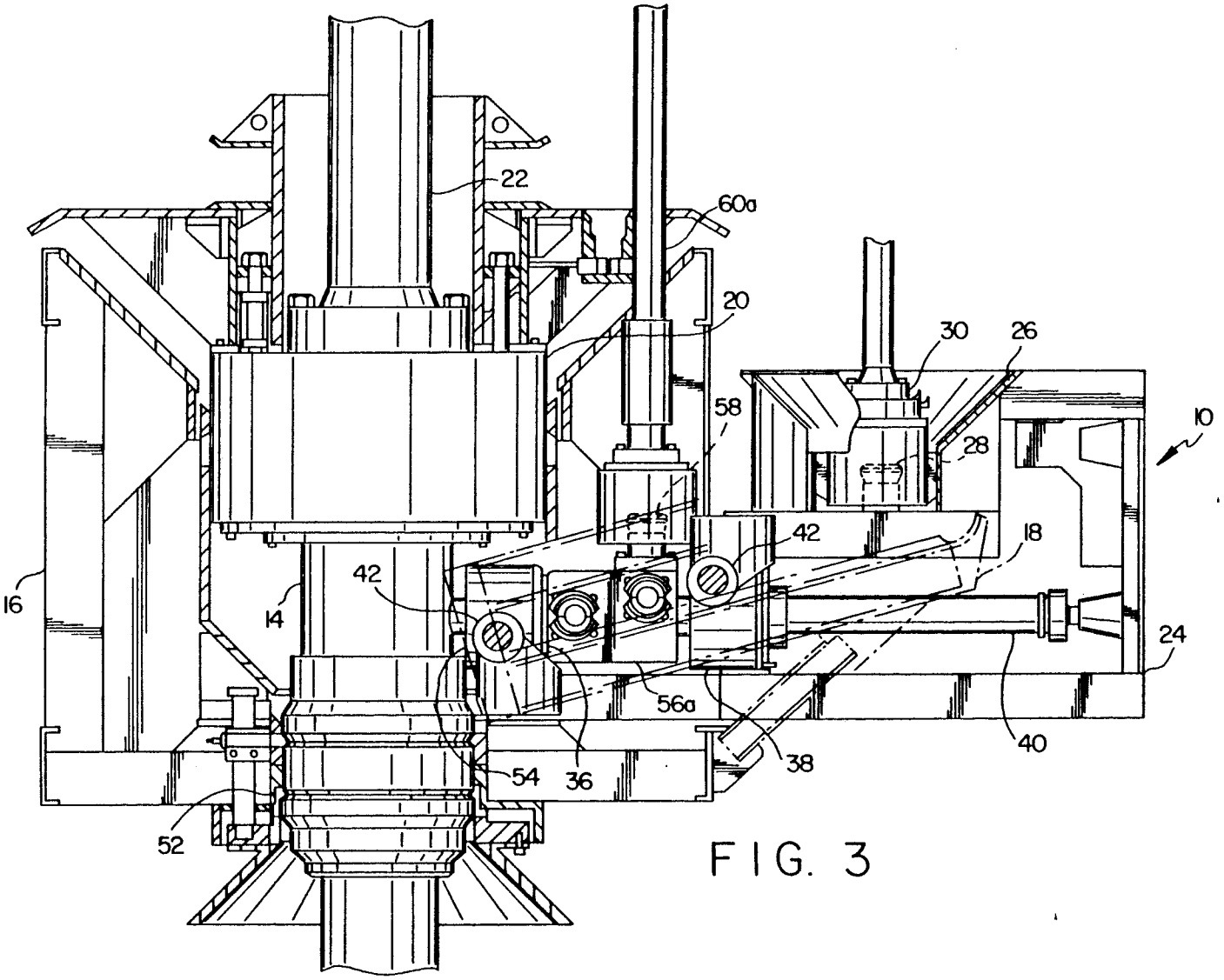
FIG. 3 is an elevation view of the guidebase, wellhead housing and inclined ramp with the rollers of the valve connection apparatus shown in position on the ramp.
Figure 4:
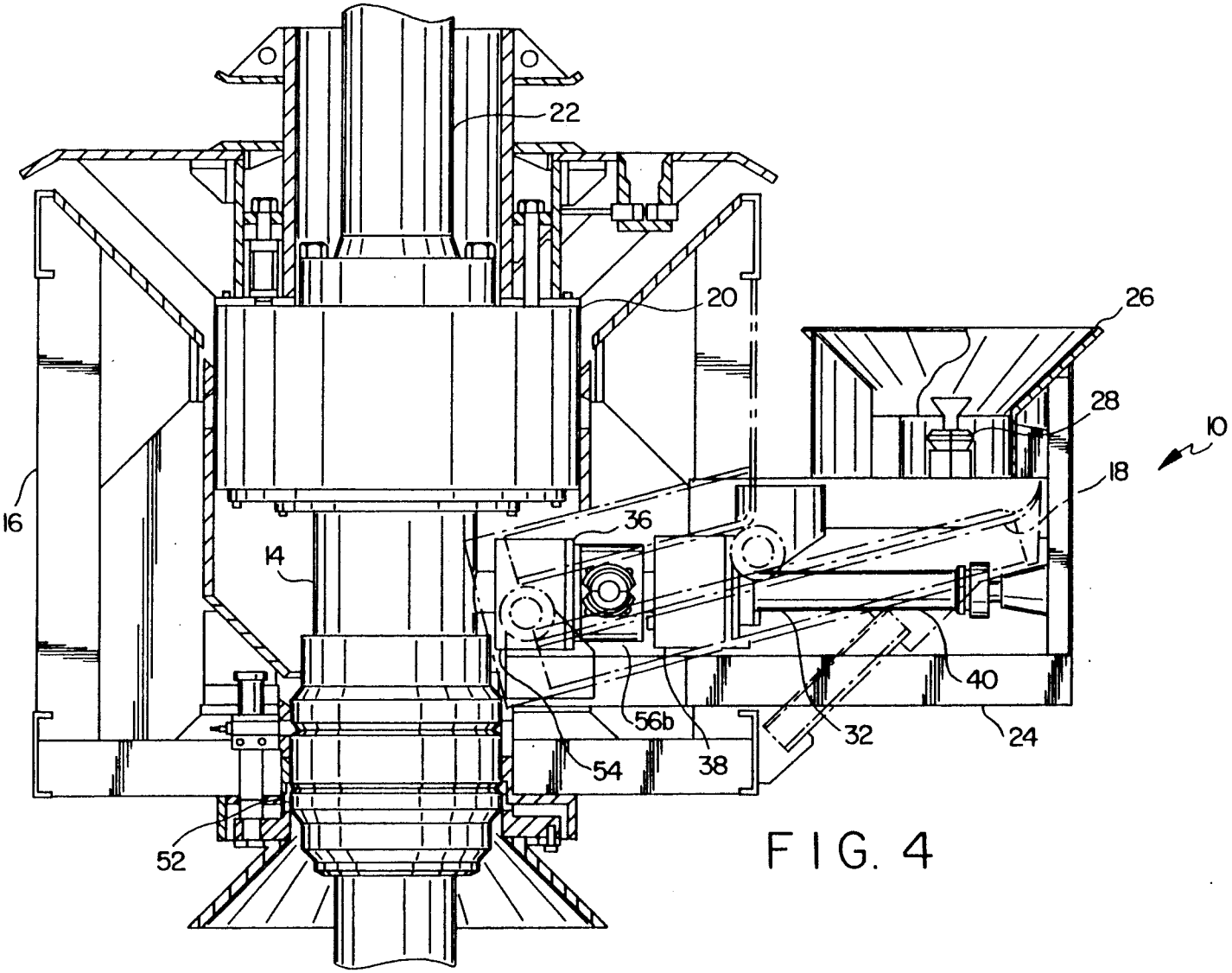
FIG. 4 is an elevation view of the guidebase, wellhead housing and inclined ramp with an alternate embodiment with the valve connection apparatus for providing horizontal access.
Figure 7:
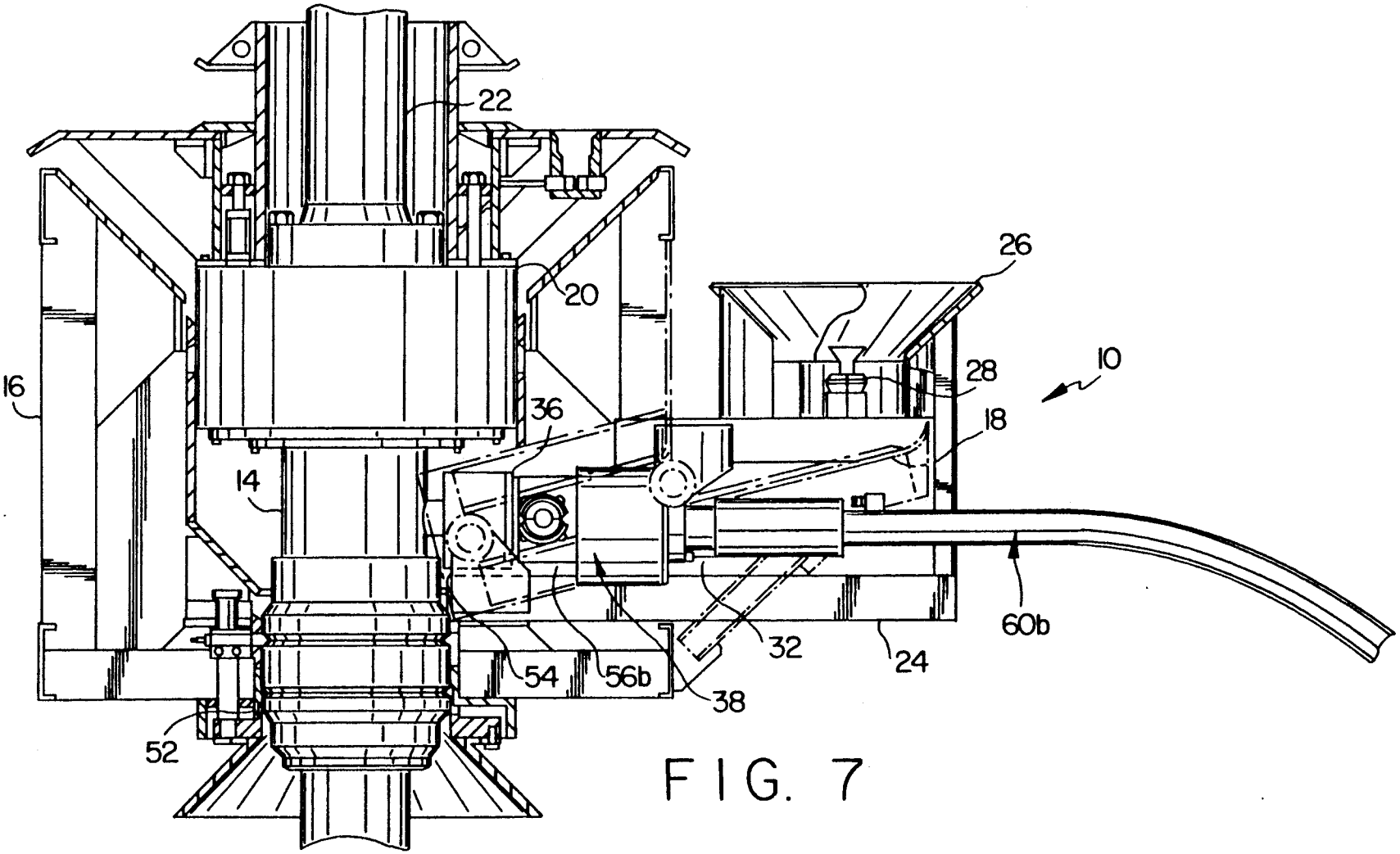
FIG. 7 is an elevation view of the guidebase, wellhead housing and inclined ramp similar to FIG. 4 with the valve connection apparatus for providing horizontal access shown in greater detail.

A typical sequence of operations for using the remotely operable horizontal connection apparatus 10 is as follows. Guidebase 16 is installed over wellhead housing 14 positioned on the seabed and oriented by orientation key 52 with inclined ramp 18 adjacent annulus access hub 12 where the plug 57 is inserted. Annulus valve connector assembly 36 includes collet connector 54 and an annulus valve 56. The annulus valve 56 may be as shown in FIGS. 1, 3 and 6 (Item **56*a*) or as shown in FIGS. 4, 5 and 7 (Item 56*b*). FIGS. 1, 3 and 6 represent a vertical access embodiment while FIGS. 4, 5 and 7 represent a horizontal annulus access embodiment. Annulus valve 56*a* provides a vertical access hub 58 to which a vertical annulus monitor/injection line 60*a* may be connected. Annulus valve 56*b* provides a horizontal access 34 to which a horizontal annulus monitor/injection line 60*b*** may be connected.

Annulus valve connector assembly 36 is positioned within support frame or installation cradle 24 and lubricator tool 32 is connected by locking collet connector 38 to hub 34. Installation tool 30 is connected to clamp hub 28 and the horizontal connection apparatus 10 is lowered on drillpipe to a position adjacent the inclined ramp 18 in a manner well known to those skilled in the art. A TV camera may be positioned on horizontal connection apparatus 10 or a remotely operated vehicle may be used to provide visual position indication.

Horizontal connection apparatus 10 is then positioned on track 44 of inclined ramp 18 and apparatus 10 is allowed to roll down ramp 18 under its own weight until connector 54 contacts hub 12 of wellhead housing 14. Connector 54 is then actuated to lock onto hub 12. Hydraulically actuated lubricator tool 40 is then used to retrieve plug 57 and thereby provide full access to the annulus.

If annulus valve **56*a* has been used the vertical annulus monitoring/injection line 60 may be connected to hub 58, by methods well known to those skilled in the art. If annulus valve 56*b* was used the hydraulically actuated lubricator 40 is retrieved and the horizontal connection apparatus 10 is used to run and make up the horizontal annulus monitoring/injection line 60*b* as shown in FIG. 7**.

When the well servicing is complete the annulus monitoring/injection line **60*b* is disconnected and the hydraulically actuated lubricator tool 40 is deployed using the horizontal connection apparatus 10 to set the plug 57. With the plug 57 in place, valve assembly 56*a* or 56*b* can be retrieved to the surface for inspection and service using the horizontal connection apparatus 10**.

The construction of my remotely operable horizontal connection apparatus and the methods of its application will be readily understood from the foregoing description and it will be seen I have provided a weight set connection apparatus for making a horizontal connection which eliminates the need for remotely operable robotic manipulators in performing such operations. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A remote horizontal connection apparatus, comprising:

a wellhead housing with an annulus port, a valve with hydraulic connector adapted for preloaded connection to said annulus port, a guide base adapted to receive said wellhead housing, a ramp disposed on said guide base, and an installation cradle for installing said valve and hydraulic connector adapted to utilize the incline of said ramp in connecting said valve to said annulus port.

2. A remote horizontal connection apparatus according to claim 1 wherein said valve and hydraulic connector assembly includes:

a hub for accessing said annulus port.

3. A remote horizontal connection apparatus according to claim 2 wherein said installation cradle includes:

a hydraulic connector for connection to said valve hub, a plug for installation within said annulus port, and a tool for remotely installing said plug within said annulus port.

4. A remote horizontal connection apparatus according to claim 3 wherein said ramp includes:

spaced apart ramp legs defining a track for said installation cradle to engage.

5. A remote horizontal connection apparatus according to claim 4 wherein said installation cradle further includes:

means for engaging said track of said ramp thereby allowing the horizontal component of the weight of said installation cradle and said valve and hydraulic connector assembly to urge said hydraulic connector into engagement with said annulus port.

6. A remote horizontal connection apparatus according to claim 5 wherein said means for engaging said track of said ramp are rollers.

7. A remote horizontal connection apparatus according to claim 6 including:

a means for orienting said wellhead housing within said guide base to place said annulus port in a preferred orientation with said ramp.

8. A weight set connection apparatus, comprising:

a wellhead housing with a substantially horizontal annulus access port, a valve with remotely operable connection means for sealingly engaging with said access port, a support structure for maintaining said wellhead housing in substantially vertical position, an inclined guide extending laterally from said support structure, and a support frame for installing said valve utilizing the slope of said inclined guide to connect said valve to said access port.

9. A weight set connection apparatus according to claim 8 wherein said valve includes:

a passageway for accessing said wellhead housing annulus access port, and a hub disposed at the outer end of said passageway.

10. A weight set connection apparatus according to claim 9 wherein said support frame further includes:

a hydraulic connector for connection to said valve hub, a plug for sealingly engaging said annulus port, and a tool for remotely installing said plug within said annulus port.

11. A weight set connection apparatus according to claim 10 wherein said inclined guide includes:

a plurality of spaced apart tracks defining a guideway sloping inwardly and downwardly for engagement by said support frame.

12. A weight set connection apparatus according to claim 11 wherein said support frame further includes:

means for engaging said tracks of said guideway thereby allowing the horizontal component of the weight of said support frame and said valve to urge said remotely operable connection means into engagement with said annulus port.

13. A weight set connection apparatus according to claim 12 wherein said means for engaging said tracks of said guideway are rollers.

14. A weight set connection apparatus according to claim 13 including:

a means for orienting said wellhead housing within said support structure to place said annulus port in a preferred orientation with said guideway.

15. A weight set connection apparatus according to claim 14 wherein:

said valve includes a vertical passageway and hub constructed and arranged to receive an annulus monitoring line for communication with said wellhead annulus access port.

16. A weight set connection apparatus according to claim 15 wherein said support frame includes:

a position sensing means for guiding said support frame into engagement with said guideway.

17. A weight set connection apparatus according to claim 16 wherein said support frame further includes:

a vertically disposed clamp hub for engagement by a remotely operable installation tool.

18. A method for establishing an annulus connection comprising the steps of:

locating an annulus access port on a wellhead housing, installing said wellhead housing in a guidebase in a preferred orientation with respect to an inclined ramp laterally disposed on said guidebase, placing a valve with remotely operable connection means for sealingly engaging said annulus access port on a support frame, lowering said valve and support frame into proximity with said inclined ramp, observing the position of said valve and support frame while lowering said valve and support frame onto said inclined ramp, allowing the horizontal component of the weight of said valve and support frame to urge said remotely operable connection means into engagement with said annulus access port, and operating said remotely operable connection means to form a sealed connection between said valve and said annulus access port.

19. A method for establishing an annulus connection according to claim 18 further comprising the steps of:

disconnecting said support frame from said valve, and retrieving said support frame.

* * * * *